US006284320B1

(12) United States Patent
Tarumi et al.

(10) Patent No.: US 6,284,320 B1
(45) Date of Patent: Sep. 4, 2001

(54) METHOD FOR PRODUCING MEMBER FOR MOLTEN METAL BATH HAVING COATING FILM EXCELLENT IN RESISTANCE TO CORROSION BY MOLTEN METAL

(75) Inventors: Kiyohiro Tarumi; Munetoshi Hiroshige, both of Tokyo (JP)

(73) Assignee: Nippon Steel Hardfacing Co., Ltd., Tokyo (JP)

( * ) Notice: Subject to any disclaimer, the term of this patent is extended or adjusted under 35 U.S.C. 154(b) by 0 days.

(21) Appl. No.: 09/530,222

(22) PCT Filed: Sep. 17, 1999

(86) PCT No.: PCT/JP99/05071

§ 371 Date: Jul. 3, 2000

§ 102(e) Date: Jul. 3, 2000

(87) PCT Pub. No.: WO00/17411

PCT Pub. Date: Mar. 30, 2000

(30) Foreign Application Priority Data

Sep. 19, 1998 (JP) ..... 10-283276

(51) Int. Cl.[7] ..... B05D 1/36; B05D 3/02

(52) U.S. Cl. ..... 427/376.2; 427/453; 427/376.3; 427/397.8; 427/419.2; 427/419.3; 427/427

(58) Field of Search ..... 427/451, 453, 427/376.2, 376.3, 397.8, 419.2, 419.3, 427, 430.1, 443.2

(56) References Cited

U.S. PATENT DOCUMENTS 4,471,023 * 9/1984 Shuford ..... 428/408
5,360,675 * 11/1994 Wood et al. ..... 428/631
5,395,661 * 3/1995 Mizunuma et al. ..... 427/451

FOREIGN PATENT DOCUMENTS 57-70275 * 4/1982 (JP) .
4-350154 * 12/1992 (JP) .
6-212379 8/1994 (JP) .

* cited by examiner

*Primary Examiner*—Shrive P. Beck
*Assistant Examiner*—Michael Barr
(74) *Attorney, Agent, or Firm*—Kanesaka & Takeuchi

(57) ABSTRACT

In a method for manufacturing a member for use in a molten metal bath, a sealing solution is applied on a coating formed of oxide system ceramics formed on an outermost surface of a substrate. The sealing solution includes an inorganic colloid compound solution containing an inorganic colloid having a grain diameter in a range of 5–50 nanometers in an amount of 5–50 weight percent, and an inorganic binder. The inorganic binder is mixed at a weight ratio of 0.3–3.0 with respect to a weight of 1.0 of the inorganic colloid. The oxide system ceramic formed on the outermost surface of the substrate is an oxide containing 5% or more of a composite oxide comprising (a) at least one of Al, Ti, V, Cr, Fe, Co, Rh, In and rare earths, which are trivalent metal elements, and (b) at least one rare earth different from that used in (a). The sealing solution on the coating after permeation is then baked.

6 Claims, No Drawings

METHOD FOR PRODUCING MEMBER FOR MOLTEN METAL BATH HAVING COATING FILM EXCELLENT IN RESISTANCE TO CORROSION BY MOLTEN METAL

TECHNOLOGICAL FIELD

The present invention relates to a manufacturing method for material for use in molten metal baths, such as rollers or the like, which are installed in molten metal baths in continuous molten metal plating lines for thin steel plates employed in the manufacture of automobiles, household electronic appliances, office equipment, construction materials, and the like, and relates to a manufacturing method for materials for use in molten metal baths having flame coatings which have superior corrosion resistance with respect to molten zinc plating baths, molten aluminum plating baths, and molten zinc-aluminum plating baths. The materials for use in molten metal baths manufactured by means of the present invention include not merely the rollers or various members which are immersed in the plating bath, but also members for metal plating accessory facilities onto which molten metal is splattered.

BACKGROUND ART

Conventionally, as rollers which were employed in continuous molten zinc plating baths, continuous molten aluminum plating baths, or continuous molten zinc-aluminum plating baths, as well as members of molten plating accessory facilities onto which these molten metals are splattered, rollers made of heat-resistant steel, the surface of which is coated with various types of cermet system materials or oxide system ceramic materials, and which is then subjected to sealing treatment using a chromic acid system solution, a metal alkoxide alcohol solution, a colloidal silica solution, or the like, are employed, and have had some success.

However, when members are employed in which various types of cermet materials or oxide system ceramic materials are flame-coated onto the surface of a roller in a molten metal plating bath, and then conventional sealing treatment is carried out, when such members are employed in molten metal baths for a long period of time, there is intrusion of molten metal into the flame coating as a result of a decline in the corrosion resistance with respect to molten metal of sealing treatment itself, or there is intrusion of molten metal into the holes present in the flame coating, and thereby, erosion or alloying of the material parts of the members for use in molten metal baths occurs, and this is a cause of peeling of the flame coating.

Furthermore, when rollers for use in molten metal plating baths are employed which have sealing treatment executed by conventional flame-sprayed surface coatings, as a result of contact with the passing plate material (steel plate), the flame coating on the surface of the roller in the bath, which was subjected to sealing treatment, is likely to be abraded, so that the sealing effect decreases, and thereby, intrusion of the molten metal into the flame coating occurs, and this is also a cause of the peeling of the flame coating as described above.

It has been proposed, in Japanese Patent Application No HEI 9-122904, that as a means for solving this problem, an oxide ceramic flame coating in which a variety of oxides are combined be formed after flame coating a cermet material, comprising metal borides within a range of 5–60 weight percent, one or more of Co, Cr, Mo, or W in an amount within a range of 5–30 weight percent, the remainder comprising metal carbides and unavoidable impurities, onto the surface of a steel member, and conducting sealing treatment using an inorganic sealing agent on this composite coating. An example of the inorganic system sealing agent described here is a colloidal silica solution. With respect to this colloidal silica solution, in general, this is a solution comprising only a colloid of ultrafine granules of silicic acid having a grain diameter within a range of 1–100 nanometers. By means of this, there is a sealing effect; however, it is not sufficient, and concrete measures for improving the properties thereof have been desired.

The present invention solves the problems described above in the conventional technology; it has as an object thereof to provide a manufacturing method for members for use in molten metal baths, which have flame coatings having superior resistance to corrosion and resistance to peeling with respect to molten metal.

DISCLOSURE OF THE INVENTION

As a result of diligent study by the present inventors in order to attain the object described above, it was learned that a flame coating for sealing by using a solution which contains inorganic binder at a weight ratio within a range of 0.3–3.0 with respect to a weight of 1.0 of inorganic colloid in an inorganic colloid compound solution containing 5–50 weight percent of an inorganic colloid having a grain diameter within a range of 5–50 nanometers, has superior corrosion resistance and resistance to peeling with respect to molten metal, and thus the present invention has been made.

In the present invention, which is based on the discovery described above, a fundamental principle is a manufacturing method for members used in molten metal baths having a coating which has superior molten metal corrosion resistance, wherein, with respect to a cermet flame coating formed on the outermost surface of a substrate, or with respect to the coating formed by oxide system ceramics formed on the outermost surface of a substrate (including a coating formed by an oxide system ceramic formed on a cermet flame coating formed on the surface of a substrate), when the coating forms the uppermost coating layer of the product, a solution in which an inorganic binder is mixed at a weight ratio within a range of 0.3–3.0 with respect to a weight of 1.0 of an inorganic colloid present in an inorganic colloid compound solution, in an inorganic colloid compound solution containing 5–50 weight percent of an inorganic colloid having a grain diameter within a range of 5–50 nanometers, is applied or sprayed as a sealing solution and is allowed to permeate, and is then baked to carry out sealing treatment.

Furthermore, it is also a fundamental principle in the present invention that the inorganic colloid compound solution contains one or more of $SiO_2$, $Al_2O_3$, $TiO_2$, and $ZrO_2$, having a grain diameter within a range of 5–50 nanometers, and that the cermet flame coating formed on the surface of the substrate contains metal borides within a range of 5–60 weight percent, and contains one or more of Co, Cr, Mo, and W in an amount within a range of 5–30 weight percent, the remainder comprising metal carbides and unavoidable impurities.

Furthermore, in the present invention, it is a fundamental principle that phosphate systems or silicate systems be used as the inorganic binder, and that the uppermost layer of the roller barrel employs a cermet flame coating or a ceramic flame coating comprising oxides.

Additionally, the present invention includes, in the fundamental principles thereof, application to those in which a) the oxide system ceramic flame coating formed on the outermost surface of the substrate comprises an oxide containing 5% or more of a compound oxide comprising one or more of Al, Ti, V, Cr, Fe, Co, Rh, In, and rare earths (Sc, Y, and lanthanides) which are trivalent metal elements, and b) one or more rare earths (Sc, Y, and lanthanides) differing from a).

The structure and function of the present invention will now be explained.

In the cermet flame coating or oxide system ceramic flame coating which is produced on the surface of rollers or members immersed in the molten metal plating bath or molten plating accessory equipment onto which molten metal is splattered, the molten metal intrudes into the holes remaining within the coating, and this is a cause of peeling of the flame coating.

In the cermet flame coating or oxide system ceramic flame coating, it is necessary to fill the holes remaining within the flame coating layer with a sealing treatment component, and furthermore, it is necessary to provide corrosion resistance with respect to molten metal, so that, in the present invention, an inorganic colloid compound solution having an inorganic colloid as the main component thereof is selected as the sealing agent.

Japanese Patent No. 2553937 discloses the formation of a cernet flame coating formed in the outermost surface of the substrate and comprising 5–60 weight percent of metal borides, and 5–30 weight percent of one or more of Co, Cr, Mo, and W, the remainder comprising metal carbides and unavoidable impurities, an oxide system ceramic flame coating, or a flame coating comprising an oxide system ceramic on top of the cermet flame coating described above formed on the surface of the substrate. Japanese Patent Publication Number HEI 5-209259, and Japanese Patent Application No. HEI 9-122904 disclose the effects of a cermet flame coating containing metal borides and an oxide system ceramic flame coating, and the effects of a flame coating consisting of the formation of an oxide system ceramic on a cermet flame coating which is formed on a substrate surface. Furthermore, the flame coating which is disclosed in "Flame Coating Material and Member Having Coating Formed by the Flame Coating Thereof" (identification number: P98NH122), which was filed on Sep. 10, 1998, exhibits characteristics superior to those before. Additionally, with respect to these flame coatings, by executing sealing treatment in accordance with the present invention, it is possible to greatly increase the effects of molten metal corrosion resistance.

Inorganic colloid employed in the present invention is used as an inorganic colloid compound solution having a grain size within a range of 5–50 nanometers. This is necessary in order to fill the holes remaining in the cermet flame coating or the oxide system ceramic flame coating, so that when the grain size is in excess of 50 nanometers, it is difficult for the granules to intrude from the surface of the flame coating, and the granules do not fill the holes remaining in the coating.

With respect to the organic colloid, organic colloidal compound having, in particular, $Sio_2$, $Al_2O_3$, $TiO_2$, and $ZrO_2$ as chief components thereof are selected. These compounds are selected because (1) they have good corrosion resistance with respect to molten metals, and (2) they are chemically stable substances.

As the sealing solution employed in the present invention a liquid solution which ultimately generates metal oxides is preferable from the point of view of permeation. It is an aqueous solution having water as the chief component thereof, pH of which is set to a range of 7–11 in order to stabilize the inorganic colloid compound solution.

By allowing the sealing liquid to penetrate the flame coating and then baking this, the aqueous component of the sealing liquid which penetrates into the spaces in the coating is evaporated, and ceramic components such as metal oxides and the like are formed in the coating and remain in a sealing state. The baking may be conducted at 450° C. and for a period of 30 minutes, and where necessary, a plurality of immersions in the same or different sealing liquids, and baking, may be conducted.

When, after the sealing treatment, the amount of one or more of $SiO_2$, $Al_2O_3$, $TiO_2$, and $ZrO_2$ generated within the flame coating layer is small, then it is difficult to fill all holes present within the flame coating layer, and the holes which are created as a result of the gas component or the water component which is released during heating after the immersion remain as holes which are not filled because the amount contained is small. Thus, the intrusion of the molten metal into these holes which remain becomes prominent, the substrate is corroded, and the flame coating is likely to peel.

Accordingly, it is necessary to use a solution having an amount containing 5% or greater, and in cases where the amount contained is in excess of 50%, the inorganic colloid compound solution becomes chemically unstable, and $SiO_2$, $Al_2O_3$, $TiO_2$, and $ZrO_2$ form large granules within the solution in the colloidal state. Accordingly, a solution is employed which has an amount contained not in excess of 50 weight percent.

By mixing silicic acid soda or aluminum phosphate or the like as an inorganic binder in the inorganic colloid compound solution, the colloidal particles such as $SiO_2$ and the like which are generated within the flame coated layer and at the surface of the flame coated layer cohere, and furthermore, the intergranular binding forces of the granules are further increased and they solidify, and the intrusion of the molten metal is prevented, so that the corrosion resistance with respect to molten metal is further increased.

In this case, with respect to the mixing proportions of the inorganic colloid compound solution and the inorganic binder which is a phosphate system or a silicate system, when the weight ratio of the inorganic binder is less than 0.3 with respect to a weight of 1.0 of the inorganic colloid within the inorganic colloid compound solution, the strengthening and improvement effects are not observed, while when this weight ratio is in excess of 3.0, the microgranules within the colloidal solution form large granules, and this is undesirable.

BEST MODE FOR CARRYING OUT THE INVENTION

The method of the present invention will be explained by an embodiment in which it is applied to a bath roller for a molten zinc-0.1% aluminum plating line which is chiefly employed in a steel manufacturing line; however, the present invention is not limited thereby.

Embodiment

For the purposes of testing, after an SUS316L steel substrate having a diameter of 30 mmϕ and a length of 300 mm was blast-treated with alumina sand, test pieces were used which had the various flame coating and sealing treatments shown in tables 1, 2, and 3 executed thereon. The thickness of the uppermost layer flame coating was 60 micrometers, and where a bond coat was formed, the thickness thereof was 40 micrometers.

With respect to the evaluation method, the test pieces were immersed in a molten zinc-0.1% aluminum bath at a temperature of 450° C., and at 5-day intervals, these were removed from the bath temporarily, and were reimmersed, and remained immersed until the total days of immersion became 60. An observation was made each time as to whether the flame coating had peeled or not, and the peeling state of the flame coating was thus assessed. The results of the testing are shown in Table 1.

TABLE 1

| | | Sealing Treatment | | | | Molten Metal Bath | | |
|---|---|---|---|---|---|---|---|---|
| | | | | | | Corrosion Resistance Test | | |
| Classification | Number | Solution (X) | Grain Diameter (nm) | Binder (Y) | X:Y | 10 days | 30 days | 60 days |
| Embodiments of the Present Invention | 1 | A | 10–30 | a | 1:1 | Θ | Θ | ○ |
| | 2 | A | 5–50 | a | 1:0.5 | Θ | Θ | ○ |
| | 3 | A | 5–50 | a | 1:1 | Θ | Θ | ○ |
| | 4 | A | 5–50 | a | 1:2 | Θ | Θ | ○ |
| | 5 | A | 10–50 | b | 1:1 | Θ | Θ | ○ |
| | 6 | A | 10–50 | c | 1:1 | Θ | Θ | ○ |
| | 7 | A | 10–50 | d | 1:1 | Θ | Θ | ○ |
| | 8 | 13 | 10–50 | a | 1:1 | Θ | Θ | ○ |
| | 9 | A | 50–100 | a | 1:1 | Θ | Δ | X |
| Comparative Examples | 10 | None | | | | ○ | Δ | X |
| | 11 | Chromic acid solution | | | | Θ | ○ | x |
| | 12 | $SiO_2$-system sol-gel solution (alkoxide solution) | | | | Θ | A | X |
| Embodiments of the Present Invention | 13 | A | 10–50 | a | 1:1 | Θ | Θ | Θ |
| | 14 | A | 10–50 | b | 1:1 | Θ | Θ | Θ |
| | 15 | A | 10–50 | d | 1:1 | Θ | Θ | Θ |
| | 16 | B | 10–50 | a | 1:1 | Θ | Θ | Θ |
| | 17 | C | 10–50 | a | 1:1 | Θ | Θ | Θ |
| | 18 | D | 10–50 | a | 1:1 | Θ | Θ | Θ |
| | 19 | E | 10–50 | a | 1:1 | Θ | Θ | Θ |
| | 20 | F | 10–50 | a | 1:1 | Θ | Θ | Θ |
| Comparative Examples | 21 | None | | | | Θ | ○ | Δ |
| | 22 | Chromic acid solution | | | | Θ | Θ | ○ |
| | 23 | $SiO_22$-system sol-gel solution (alkoxide solution) | | | | ○ | A | |

Note 1: Uppermost layer flame coating layer
Number 1–12: WC—50% WB—10% CO
Number 13–23: $Cr_2O_3$ + 10% $YCrO_3$ (Numbers 13–15 and numbers 18–20 have a bond coat [WC—50% WB—10% Co])
Note 2: Leaking test. After immersion in a 450° C. molten zinc bath, extraction and comparison.
Θ: no zinc adhering
○: partial deposition of zinc; however, it is easily removed
A: partial peeling of the coating or partial deposition of zinc which can not be easily removed
X: deposition of zinc over entire surface or widespread peeling of the coating
Note 3: X:Y Mixing weight ratio (X: inorganic colloid component, Y: inorganic binder)

TABLE 2

| Type of Inorganic Colloidal | Chemical Component Containing Oxides (%) | | | | | Solution Component (%) | |
|---|---|---|---|---|---|---|---|
| Solution | $SiO_2$ | $Al_2O_3$ | $TiO_2$ | $ZrO_2$ | $Na_2O$ | $HNO_3$ | $H_2O$ |
| Solution A | 5 | 5 | — | — | 0.5 | — | Remainder |
| Solution B | 30 | — | — | — | 0.5 | — | Remainder |
| Solution C | 30 | 5 | 5 | — | 0.5 | — | Remainder |
| Solution D | — | 30 | 5 | 5 | — | 2 | Remainder |
| Solution E | — | — | 20 | 20 | — | 2 | Remainder |
| Solution F | — | 10 | — | 30 | — | 2 | Remainder |

Note: The values indicate weight %.

TABLE 3

| Type of Inorganic Binder | Solution Components (weight %) | | | | | |
|---|---|---|---|---|---|---|
| Solution | $P_2O_5$ | $Al_2O_3$ | $Na_2O$ | $SiO_2$ | $K_2O$ | $H_2O$ |
| a (aluminum phosphate system) | 32 | 8 | | | | Remainder |
| b (sodium phosphate system) | 28 | | 12 | | | Remainder |
| c (sodium silicate system) | | | 10 | 30 | | Remainder |
| d (potassium silicate system) | | | | 30 | 20 | Remainder |

In Table 1, numbers 1–8 and numbers 13–20 are embodiments of the present invention, while numbers 9 through 12 and numbers 21–23 are comparative examples.

In the embodiments of numbers 1–8 and numbers 13–20 (in numbers 13–15 and number 18–20, a flame coating having a thickness of 40 micrometers and comprising WC-50% WB-10% Co was formed as a bond coat), the various sealing treatments of the present invention were conducted with respect to those having the typical cermet materials, which are actually employed as materials for molten metal baths in actual baths in molten zinc plating lines, or having metal oxide system ceramic materials, as coatings which are flame-coated layers on the uppermost layer.

In addition, numbers 10–12 and numbers 21–23 are comparative examples which employ the conventional sealing treatments on the flame-coated layers described above, and number 9 is a comparative example which conducts a sealing treatment with a sealing agent in which the inorganic colloid granules are outside the predetermined ranges.

It can be understood from Table 1 that the members for use in molten metal baths produced by means of the present invention, in comparison with members using the conventional sealing techniques, have no peeling of the flame coating in a molten zinc-0.1% aluminum bath immersion, and possess superior corrosion resistance with respect to molten metal baths. In the present embodiment, the results were applied to a molten zinc-0.1% aluminum plating bath; however, similar effects are obtainable in other embodiments in which application is to a molten aluminum plating bath or a molten zinc-50% aluminum plating bath, so that the effects of the present invention are confirmed.

Industrial Applicability

The composition of the present invention is as described above, so that it is possible to provide a manufacturing method for members for use in molten metal baths, which forms a sealed flame coating having superior corrosion resistance with respect to molten zinc baths or molten zinc-aluminum baths and superior resistance to peeling, and it becomes possible to operate a plating line continuously for a long period of time, and this is extremely useful in manufacturing.

What is claimed is:

1. A manufacturing method for a member with a coating having molten metal corrosion resistance for use in a molten metal bath, comprising:

applying, on a coating formed of oxide system ceramics formed on an outermost surface of a substrate, a sealing solution including an inorganic colloid compound solution containing an inorganic colloid having a grain diameter within a range of 5–50 nanometers in an amount of 5–50 weight percent, and an inorganic binder, said inorganic binder being mixed at a weight ratio of 0.3–3.0 with respect to a weight of 1.0 of the inorganic colloid, said oxide system ceramics formed on the outermost surface of the substrate being an oxide containing 5% or more of a composite oxide comprising (a) at least one of Al, Ti, V, Cr, Fe, Co, Rh, In and rare earths, which are trivalent metal elements, and (b) at least one rare earth different from that used in (a), and baking the sealing solution on the coating after permeation.

2. A manufacturing method according to claim 1, wherein said oxide system ceramics formed on the outermost surface of the substrate are coated on a cermet flame coating on the substrate.

3. A manufacturing method according to claim 2, wherein said rare earths used in (a) and (b) comprise Sc, Y or lanthanides.

4. A manufacturing method according to claim 1, wherein said inorganic colloid contained in the inorganic colloid compound solution is at least one member selected from the group consisting of $SiO_2$, $Al_2O_3$, $TiO_2$, and $ZrO_2$.

5. A manufacturing method according to claim 1, wherein phosphate systems or silicate systems are employed as the inorganic binder.

6. A manufacturing method according to claim 1, wherein the member is a roller barrel, and a cermet flame coating or ceramic flame coating comprising oxides as the coating formed of oxide system ceramics is formed on the uppermost layer of the roller barrel.

* * * * *